United States Patent [19]

Kastelic et al.

[11] Patent Number: 4,754,591

[45] Date of Patent: Jul. 5, 1988

[54] CONSTRUCTION AND REPAIR OF REFRACTORY STRUCTURES, IN PARTICULAR HEATED STRUCTURES

[75] Inventors: Wilhelmus A. Kastelic, IJmuiden; Arie J. Nuysink, Heemskerk, both of Netherlands

[73] Assignee: Hoogovens IJmuiden B.V., IJmuiden, Netherlands

[21] Appl. No.: 925,527

[22] Filed: Oct. 28, 1986

Related U.S. Application Data

[63] Continuation of Ser. No. 828,086, Feb. 10, 1986, abandoned, which is a continuation of Ser. No. 610,943, May 17, 1984, abandoned, which is a continuation of Ser. No. 353,821, Mar. 2, 1982, abandoned, which is a continuation of Ser. No. 044,352, May 31, 1979, abandoned.

[30] Foreign Application Priority Data

Jun. 2, 1978 [NL] Netherlands ..... 7806005

[51] Int. Cl.[4] ..... F04G 23/02

[52] U.S. Cl. ..... 52/747; 52/232; 52/442; 52/309.17; 52/436

[58] Field of Search ..... 52/747, 232, 442, 436, 52/309.17

[56] References Cited

U.S. PATENT DOCUMENTS

| | | | |
|---|---|---|---|
| 1,252,415 | 1/1918 | Duckham | 52/573 |
| 2,296,392 | 9/1942 | Marchant | 52/573 |
| 2,476,305 | 7/1949 | Kimmel | 52/747 |
| 2,829,877 | 4/1958 | Davis | 52/599 |
| 3,237,359 | 3/1966 | Charvat | 52/573 |
| 3,324,810 | 6/1967 | Neely | 110/338 |
| 3,616,108 | 10/1971 | Whitehouse | 266/285 |

FOREIGN PATENT DOCUMENTS

| | | |
|---|---|---|
| 1558568 | 4/1970 | Fed. Rep. of Germany . |
| 59948 | 5/1958 | Luxembourg . |
| 1062348 | 3/1965 | United Kingdom . |
| 1091163 | 11/1967 | United Kingdom . |
| 1144027 | 3/1969 | United Kingdom . |

*Primary Examiner*—John E. Murtagh

*Attorney, Agent, or Firm*—Stevens, Davis, Miller & Mosher

[57] ABSTRACT

The invention provides a method of building or repairing refractory brickwork structures that are subjected to local differences in thermal expansion. The brickwork joints are made with a suitable sintering refractory mortar and in most or all of the joints there is also provided a synthetic material layer that changes into gaseous products when heated, without leaving any substantial solid residue and without reacting chemically with the refractory structure. The volume of the layers is not more than 95% of the thermal expansion of the brickwork adjacent the joints during heating up to working temperatures, so that the joints are left in compression to ensure gas tightness.

6 Claims, 1 Drawing Sheet

CONSTRUCTION AND REPAIR OF REFRACTORY STRUCTURES, IN PARTICULAR HEATED STRUCTURES

This application is a continuation of application Ser. No. 828,086 filed Feb. 10, 1986, which is a continuation of application Ser. No. 610,943 filed May 17, 1984 which is a continuation of application Ser. No. 353,821 filed Mar. 2, 1982 which is a continuation of application Ser. No. 44,352 filed May 31, 1979 all now abandoned.

BACKGROUND OF THE INVENTION

The invention relates to a method of building from refractory bricks a refractory structure or part of such a structure, which while being heated to working temperature and/or built is subject to local differences in thermal expansion and measures are taken to counterbalance these differences.

Although the invention will chiefly be explained with reference to its application to the construction and repair of coking chamber walls, it is not restricted to this.

When building new refractory structures and in particular coking chambers, allowance should be made for considerable and frequently uneven thermal expansion of the refractory structure. This particularly holds good if silica, which is commonly used for coking chambers, is used as the material for the shaped bricks. This is the result of the very pronounced and uneven expansion behaviour of silica even at low temperatures. In the past measures have been suggested to remedy the harmful results of this expansion, by continuously seeking solutions involving expansion joints being built in between larger parts of the structure.

A drawback of this method consists in that uneven expansion cannot be counterbalanced sufficiently in this way, and that consequently local damage may occur. Besides, the large movements of parts of the structure result in structural problems in counterbalancing these movements.

It is often common practice in repair work to coking chamber walls to employ spraying methods. However, if the damage to the brickwork of a coking chamber wall becomes too great it is no longer sensible to apply such spraying methods and generally speaking the damaged wall or just the damaged brickwork in this wall will be partially or completely replaced. Cooling of a complete coking chamber for carrying out a comparatively small repair job itself results in substantial damage to the brickwork. For this reason such repair jobs are frequently performed in such a way that the parts of the wall which need not be repaired are kept at the required temperature. In principle it is preferable to lay the new bricks bonded to the remaining old parts of the wall in order to achieve as stable a wall structure as possible.

The difficulty arising here is the fact that the still hot existing brickwork has already expanded, while the new and cold masonry will expand as it is heated to the same temperature. This results in damage not only to the new brickwork, but also to the existing brickwork and to its adhesion. These drawbacks are in particular felt if the wall consists of silica bricks, which exhibit a particularly uneven and large thermal expansion.

All kinds of suggestions have been made to solve the problems of the uneven thermal expansion between the existing and the new brickwork but so far without obtaining a generally satisfactory solution. For instance the suggestion has been made to apply compressible mortar masses. However, the result is a structure which differs locally from the remainder of the brickwork, while it is also evident that the uneven expansion of the replacement brickwork cannot be sufficiently counterbalanced by using compressible types of mortar.

It is also evident that in brick-laying with such types of mortar the supporting function of the replacement brickwork is insufficient if it must for example support an oven deck of a coking chamber. This eventually necessitates the use of additional expensive and complicated aids to support the oven deck. Another suggestion made is to build the replacement brickwork into the existing wall with joints or cavities in order to be able to make up for thermal expansion of the replacement material. However, as a result of uneven expansion of the replacement brickwork gaps occur in the brickwork in this manner, which are particularly objectionable in a coking chamber. It is also clear that the uneven expansion of the replacement brickwork cannot be sufficiently counterbalanced while the chamber is being heated on account of joints between the replacement brickwork and the existing brickwork.

Besides, by failing to bond the bricks connecting the existing and replacement brickwork, a structure results without much stability. It has been suggested previously to obtain the required bond despite this by making the bricks employed at the region of connection thinner and to apply in those places thicker, and if required compressible, joints.

Proposals have also been made (U.S. Pat. No. 2,985,442 and U.K. Pat. No. 1 298 079) to provide expansion joints by the use of cardboard or pasteboard inserts which burn away when the brickwork is heated. In the case of U.K. Pat. No. 1 298 079 it is suggested that such inserts may be put in occasional ones of successive joints between bricks of a refractory brickwork lining to permit expansion of the bricks when the inserts have burned away. However, these inserts are insufficient to provide the necessary expansion of the brickwork as they can be spaced no closer than every fifth joint, because the gaps left when they have burned away are prevented by friction from closing properly and more of such inserts would therefore prevent the formation of a tight brickwork lining. The major part of the necessary thermal expansion must therefore be accommodated by a loose packing of a compressible material, which can lead to problems as already explained above.

SUMMARY OF THE INVENTION

The aim of the invention is to provide a new method for erecting new structures as well as for repairing the damaged parts of a refractory structure kept hot, avoiding the above-described problems. In particular in a brickwork repair the aim is to obtain a structure in which existing and replacement brickwork are bonded together and no unduly high thermal stresses occur in the brickwork.

According to the invention, in a manner known per se the bricks are laid with a refractory mortar which sinters when heated and that in addition layers of synthetic material are provided for example as plates, in the longitudinal and cross joints along their entire lengths, the volume of which layers corresponds to a maximum of 95%, and preferably 80 to 90%, of the thermal expansion of the brickwork adjacent to the joints during heating up to working temperature, and the synthetic layers are of a material which changes when heated into gaseous products without leaving any substantial solid residue and without reacting chemically with the refractory structure.

By applying these synthetic layers in at least most of the joints the result can be achieved that wherever the structure starts to expand while it is being heated, space is created as a result of decomposition of the synthetic material. Up to the time that this happens the synthetic material layers have a supporting function, but thereafter expansion proceeds locally without being materially affected by the adjacent parts of the structure. As a result the brickwork structure can be heated up considerably more quickly so that there is a substantial saving of time.

The use of synthetic material per se as expansion material in refractory structures has already been suggested before, but the material was then applied in a dry condition between successive bricks, and only at large intervals. According to the present invention the synthetic layers are applied together with the mortar, in most if not all of the joints. In doing so a type of mortar can be used which is normal and usual for the brickwork of the refractory wall in question, and which is thus suitable to fulfil at the same time satisfactory supporting, refractory and sealing functions.

As the synthetic material decomposes the adjacent surfaces of the joint and of the mortar respectively close. Surprisingly it appears that even at the usual temperatures of these structures sintering still occurs at the new boundary surfaces, so that at working temperature a monolithic refractory structure is obtained which is adequately gastight.

Although in theory it is not necessary to provide all the joints with synthetic material it has nevertheless become clear that the best results are achieved if hard synthetic material plates are built into all or at least practically all the joints of the replacement brickwork.

It is in particular evident that satisfactory results may be achieved by using synthetic material plates made from hard polystyrene. When heated this material changes into gaseous products at approximately 200° C. without reacting with the brick material or the mortar. Even when approaching the temperature at which it decomposes, the polystyrene is found to retain a suitable supporting function in the structure.

Not only is the method according to the invention of considerable value in building a new structure at ambient temperature to be subsequently heated up, but in particular it is also useful in local repair work to a refractory structure that is being kept hot, such as for instance a coking chamber wall.

The synthetic material can be built in as separate members, but it is also possible within the scope of the invention to pre-attach the material to the shaped bricks. To this end synthetic plates can be cemented to the bricks in advance, or the bricks can be provided with a thick coating layer of the synthetic material.

The thickness of the synthetic material can be calculated in accordance with the nature and size of the refractory material. If the method is for example applied to a refractory structure built from shaped silica bricks, it appears satisfactory results can be achieved by applying synthetic material plates of a thickness of approximately 2 mm. If necessary several plates can be provided locally in one and the same joint.

In structures composed of shaped bricks which interlock the bricks should be applied with special care. In order to simplify the construction work in spite of this, it is desirable in such a case to make use of pre-shaped synthetic material plates which are adapted to the interlocking profile. In particular bricks can be employed for this purpose with so-called "tongue and groove" profiling, which are frequently used if the structure requires added anchoring. This anchorage is necessary for instance as a result of the possibility of expansion built into the structure.

It will be clear that the need to anchor a structure with shaped bricks may be less evident when the method of the present invention is used, because wide and long expansion joints which reduce the cohesion of the refractory structure, can be avoided. As a result, more use can be made of standard-sized bricks, which can lead to further simplification and cost reduction of the structure.

The invention will be further exemplified with reference to the accompanying drawings.

DESCRIPTION OF THE PREFERRED EMBODIMENTS

Figure 1:
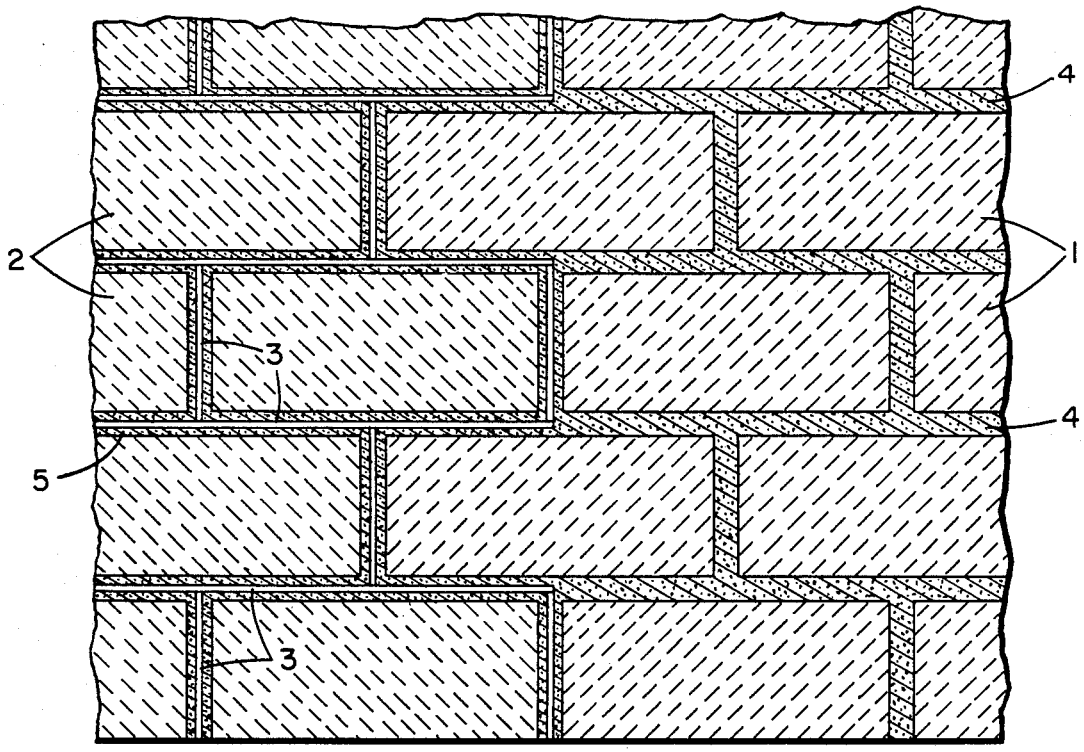
FIG. 1 shows the adaptation of new to old brickwork.

In FIG. 1, reference numeral 1 (hatching running upwards and rightwards) shows existing silica brickwork of a coking chamber wall in a hot condition. Repair brickwork 2 (hatching running upwards and leftwards) is built into the existing brickwork cold.

Around the bricks of the repair brickwork 2 hard polystyrene plates 3 measuring 2 mm in thickness are set in the refractory mortar 4. The joints 5 in the new brickwork are dimensioned in such a way that the cold and the hot brickwork fit evenly. As the brickwork 2 gets hotter the bricks expand. Simultaneously plates 3 start to change into gaseous products. As soon as the silica bricks achieve their expansion at temperatures between 200° C. and 300° C. the plates 3 have disappeared completely. The layers of cement mortar on either side of the area where each plate 3 has been once again joined. As the temperature continues to rise the joints 5 close completely by sintering. The various dimensions are chosen such that there is still about 10% of the final expansion of the replacement bricks remaining when the plates have been destroyed and the cement mortar layers first meet. This ensures that the whole replacement structure remains slightly compressed, which will benefit the gas tightness of the wall.

Figure 2:
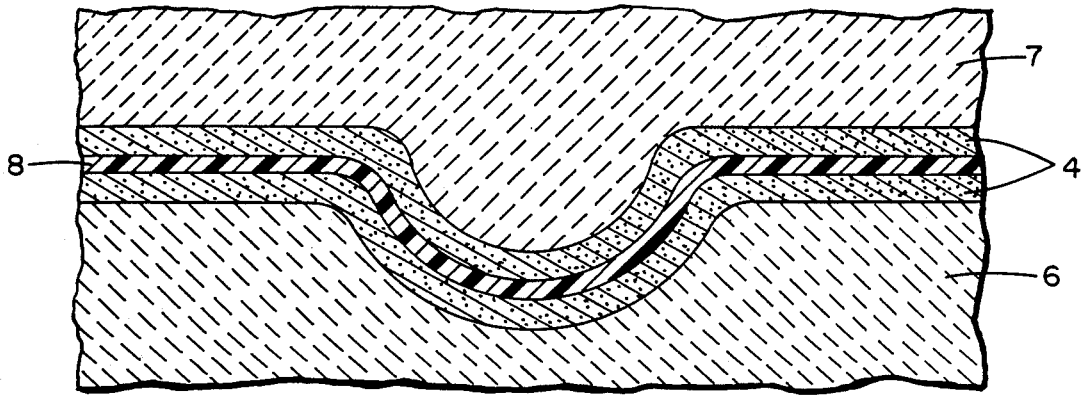
FIG. 2 shows a detail of a tongue and groove joint.

FIG. 2 shows the joint of two shaped bricks 6 and 7 with a tongue and groove interlocking profile. In the joint a preshaped synthetic material plate 8 is provided in the mortar 4. The plate 8 is shaped in such a way that it matches the tongue and groove profile of the bricks 6 and 7.

Figure 3:
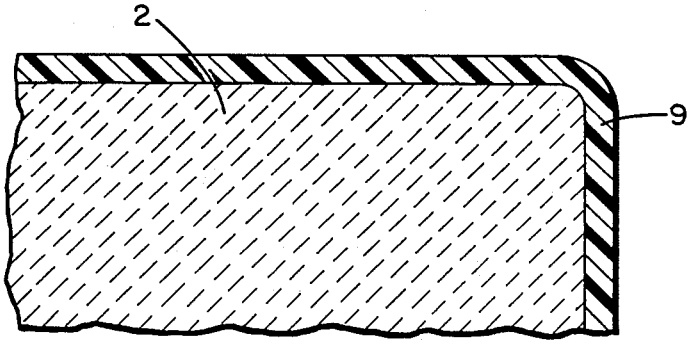
FIG. 3 shows a detail of a coated brick.

FIG. 3 shows a part of a refractory brick 2 for use in the method according to the invention, in which the layer of synthetic material is provided as a coating 9 on the bonding faces of the brick. The refractory mortar is applied to the surface of the coating in building the brickwork.

What is claimed is:

1. A method of building at least a part of a refractory structure into a gastight monolithic refractory structure of refractory brick comprising laying the bricks with longitudinal and cross joints between them, filling the joints along the length of at least most of the joints with a composite consisting essentially of a refractory mortar that sinters when heated to a working temperature and a layer of synthetic material hard polystyrene which when heated to said working temperature changes into a gaseous product without leaving any substantially solid residue, the volume of the layers being not greater than 95% of the thermal expansion of the brickwork adjacent the joints during heating to said working temperature, and heating said joints and composite to said working temperature whereby the synthetic material changes into gaseous products without any substantially solid residue and without reacting chemically with the refractory structure and adjacent surfaces of mortar of the joint meet and sinter to form the gastight monolithic refractory structure under compression consisting of sintered mortar and brick.

2. A method according to claim 1 wherein the volume of said synthetic material is between 80% and 90% of the thermal expansion of the brickwork adjacent the joints during heating up to working temperature.

3. A method according to claim 1 wherein the synthetic material is provided in the form of plates.

4. A method according to claim 3 wherein the synthetic material in the form of plates approximately 2 mm thick.

5. A method according to claim 1 wherein said bricks are laid to provide a replacement brickwork in part of a heated structure, such as a coking chamber, which is maintained at an elevated temperature during the building of the replacement brickwork.

6. A method according to claim 1 when applied to a structure comprising shaped bricks having interlocking profiles, and wherein said synthetic material is provided at the joints between profiles in the form of preshaped plates of the material adapted to the interlocking profile of the bricks.

* * * * *